US005669601A

United States Patent [19]

Fisher

[11] Patent Number: 5,669,601

[45] Date of Patent: Sep. 23, 1997

[54] SHEET FEEDING DEVICE WITH FLOATING GUIDE

[75] Inventor: Terrence L. Fisher, Rochester, N.Y.

[73] Assignee: Eastman Kodak Company, Rochester, N.Y.

[21] Appl. No.: 657,841

[22] Filed: May 31, 1996

[51] Int. Cl.[6] ..... B65H 5/22

[52] U.S. Cl. ..... 271/3.08; 271/117; 271/121; 271/126; 271/170; 271/306

[58] Field of Search ..... 271/3.08, 3.01, 271/3.03, 117, 118, 121, 126, 163, 169, 170, 306, 902

[56] References Cited

U.S. PATENT DOCUMENTS

| | | | |
|---|---|---|---|
| 3,291,494 | 12/1966 | Gibb | 271/306 |
| 3,674,256 | 7/1972 | Brooktyser | 271/306 |
| 4,037,953 | 7/1977 | Sone et al. . | |
| 4,682,768 | 7/1987 | Iida et al. | 271/3.01 |
| 5,027,587 | 7/1991 | Ramsey . | |
| 5,043,770 | 8/1991 | Nagano et al. . | |
| 5,052,673 | 10/1991 | Tokuda et al. | 271/117 |
| 5,137,174 | 8/1992 | Bell . | |
| 5,320,338 | 6/1994 | Shinolhara et al. . | |

FOREIGN PATENT DOCUMENTS

| | | | |
|---|---|---|---|
| 363208460 | 8/1988 | Japan | 271/3.03 |
| 0386737 | 9/1990 | Japan | 271/170 |
| 404140239 | 5/1992 | Japan | 271/170 |

*Primary Examiner*—H. Grant Skaggs
*Attorney, Agent, or Firm*—Milton S. Sales

[57] ABSTRACT

A sheet feeding device is particularly useful in feeding sheets from a stack in apparatus in which a trailing portion of the sheet is returned toward the stack as the sheet moves through a reciprocating path. Corner nails used to help prevent double feeds in the sheet feeding device are attached to a guide means positioned to guide the trailing portion above the stack. The nails and guide means float vertically with respect to the top of the stack, preventing interference between the leading edge of the sheet and the guide means and between the trailing edge of the sheet and the stack.

7 Claims, 6 Drawing Sheets

FIG. 5
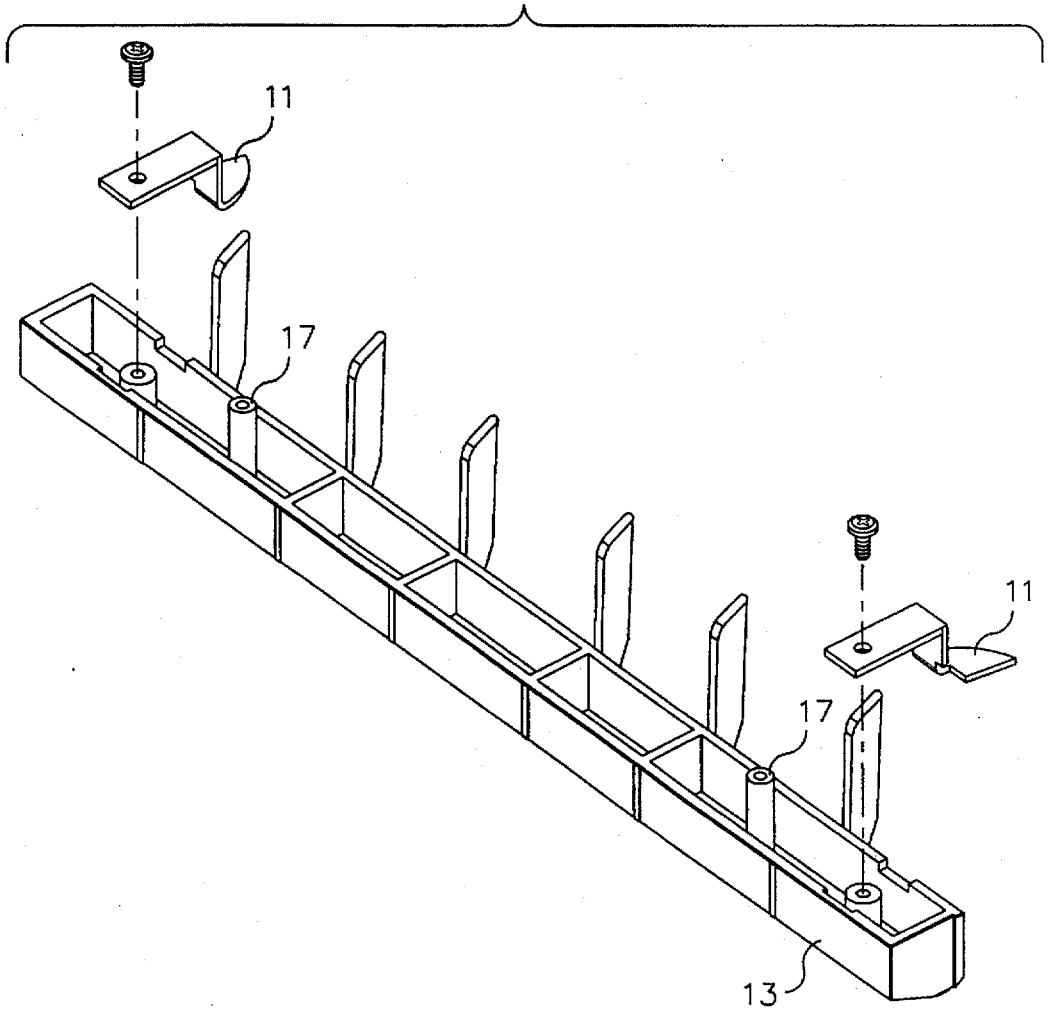
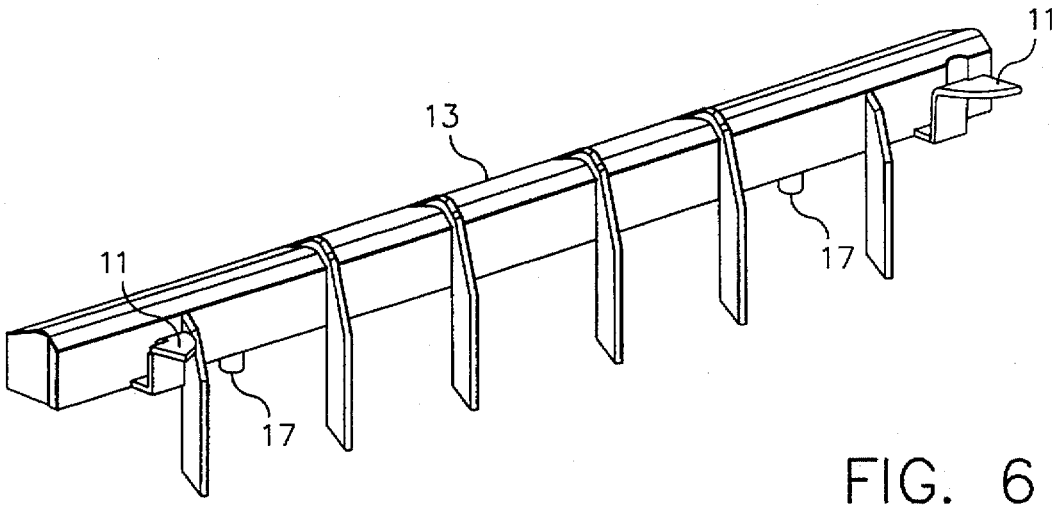
FIG. 6

SHEET FEEDING DEVICE WITH FLOATING GUIDE

This invention relates to sheet feeding devices. Although not limited thereto, it is particularly useful with printers in which a sheet is fed several times to a single print station.

Many printers place a stack of image receiving sheets in a storage tray, pick the top sheet of the stack and feed the sheet to a print station. In some printers, for example, some thermal printers, the sheet must be fed to the print station one time for each of several colors. Some printers move the sheet reciprocally through the print station two or more times with the trailing portion of the sheet returning toward its original supply between images. Such devices employ a guide to force the trailing portion of the sheet above the stack when it returns to avoid jams from it striking the stack.

In the KODAK Digital Printer, Model 1000 marketed by Eastman Kodak Company sheets are separated by a scuff roller that pushes the sheet off the stack while corner devices, commonly called "nails" resist movement of the sheet at the corners of the leading edge. The nails are well known devices which force a loop in the top sheet which prevents double feeding. Some printers, for example, some laser printers, handle varying paper stack heights, it is common to allow the corner devices to float on the top of the stack as it varies its vertical position.

SUMMARY OF THE INVENTION

A problem encountered in adapting the floating aspect of the corner devices to a printer that returns the sheet to the sheet supply area is that floating corner devices allow this stack to position itself vertically higher when not engaged by the picking scuff roller. When the sheet returns to the supply area, the trailing edge abuts the raised stack and causes a jam. It is an object of the invention to cure this problem.

According to the invention, this and other objects are accomplished by a sheet feeding device having means for receiving a stack of sheets, corner means for engaging two corners of a top sheet in a received stack and guide means positioned adjacent a received stack with the corner means between the stack and the guide means. The corner means and the guide means are supported for movement together between positions which are determined by the top sheet of the stack.

According to a preferred embodiment, a single integral unit includes both the guide means, which guides the returning sheet above the stack, and the corner devices. The integral unit is mounted for sliding movement vertically as controlled by the engagement between the corner devices and the top of the stack.

Thus, the guide is positioned low enough to permit feeding a sheet initially from the stack but then high enough to force the returning sheet above the stack. Its position is automatically controlled by the corner devices which are responsive to the location of the top of the stack as the scuff roller engages and disengages from the stack.

BRIEF DESCRIPTION OF THE DRAWINGS

FIGS. 5 and 6 are perspectives of a guide and corner piece component with portions exploded in FIG. 5.

DETAILED DESCRIPTION OF THE INVENTION

The invention can be used to feed sheets in a variety of apparatus. It is particularly useful in a sheet supply in which, for whatever reason, a sheet that has been fed from the supply has at least its trailing portion returned briefly into the supply area as the sheet goes through its full process cycle. The sheet could be entirely returned into a position from which it is refed or it can be returned partially into the supply area before being reversed in direction.

Figure 1:
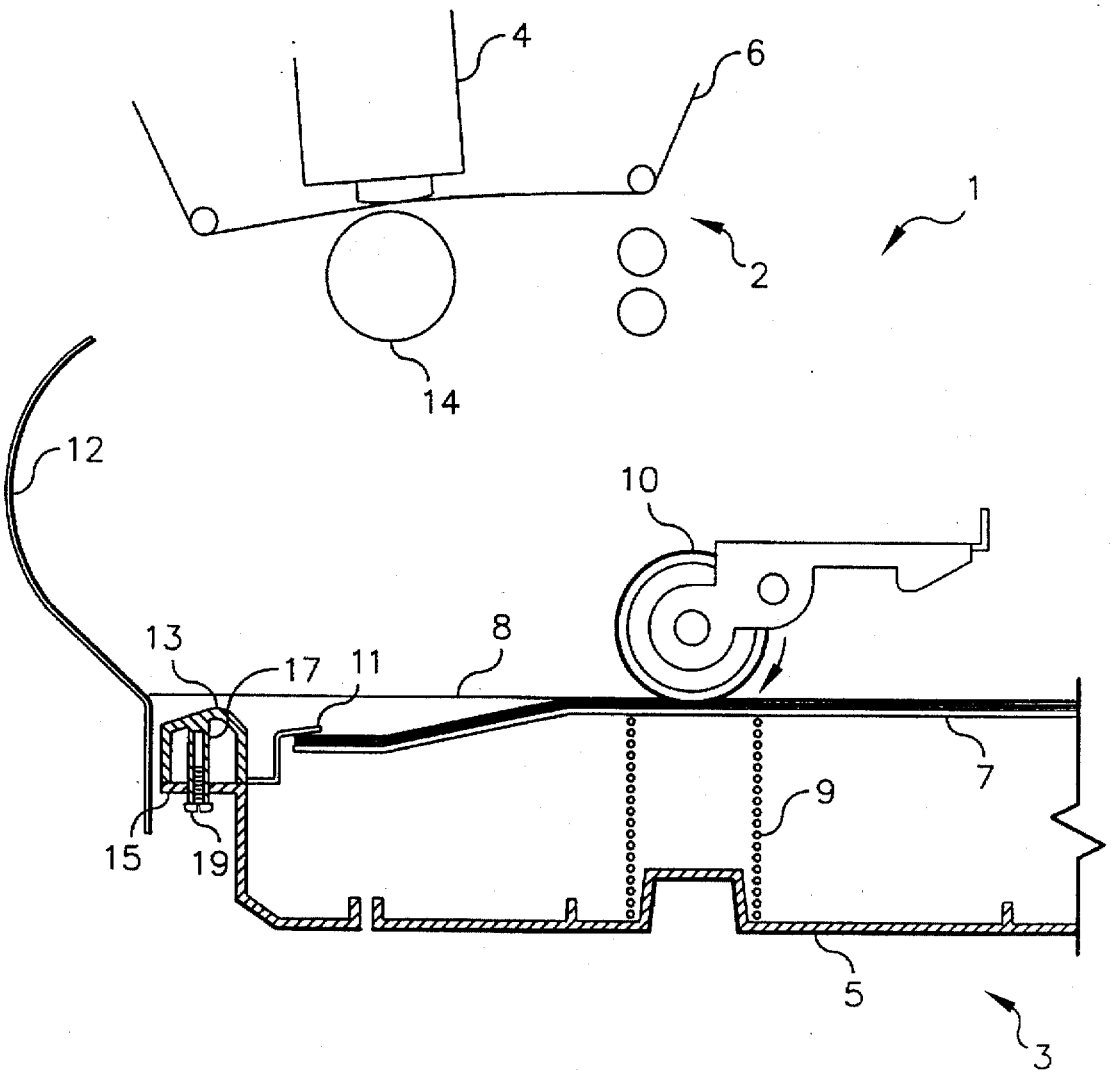
FIGS. 1 and 2 are side schematics of sheet supply and printing station portions of a printer.
Figure 2:
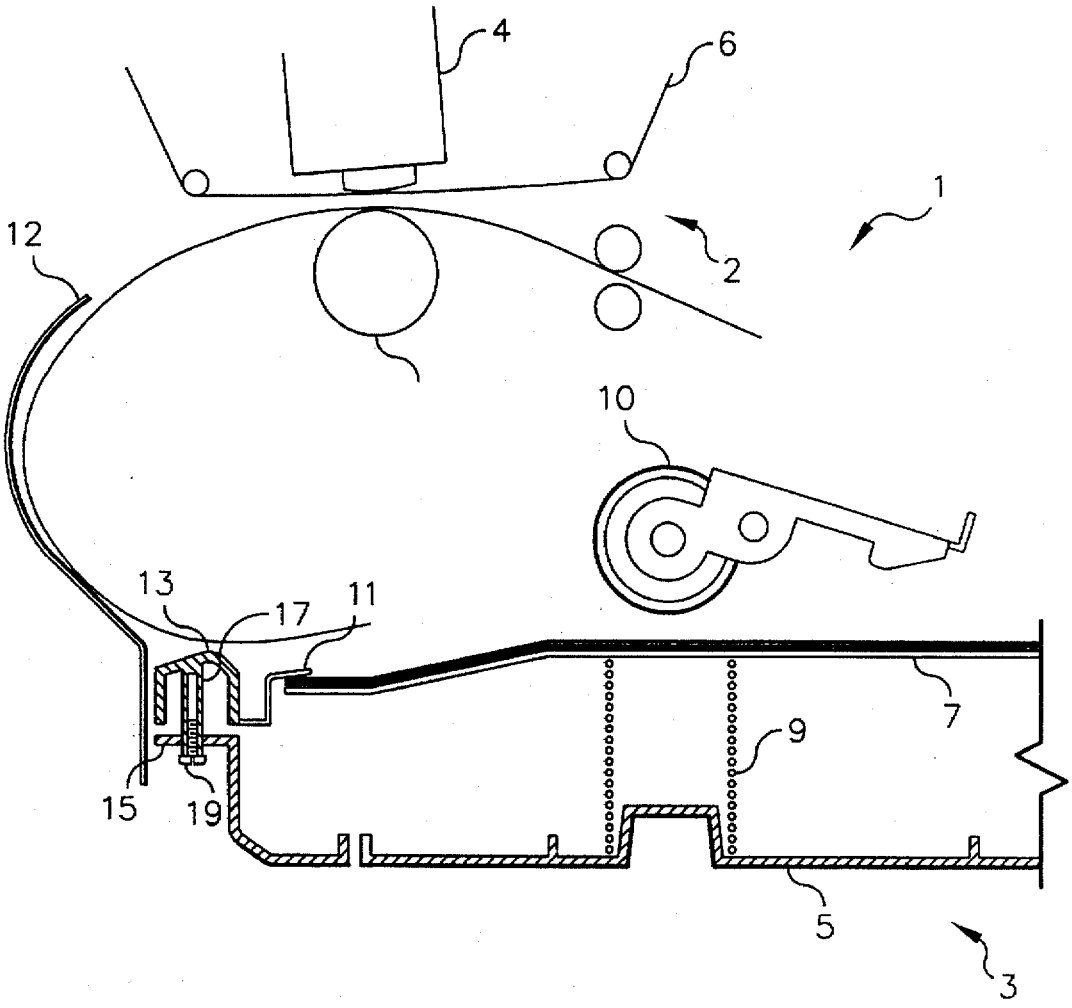
Figure 3:
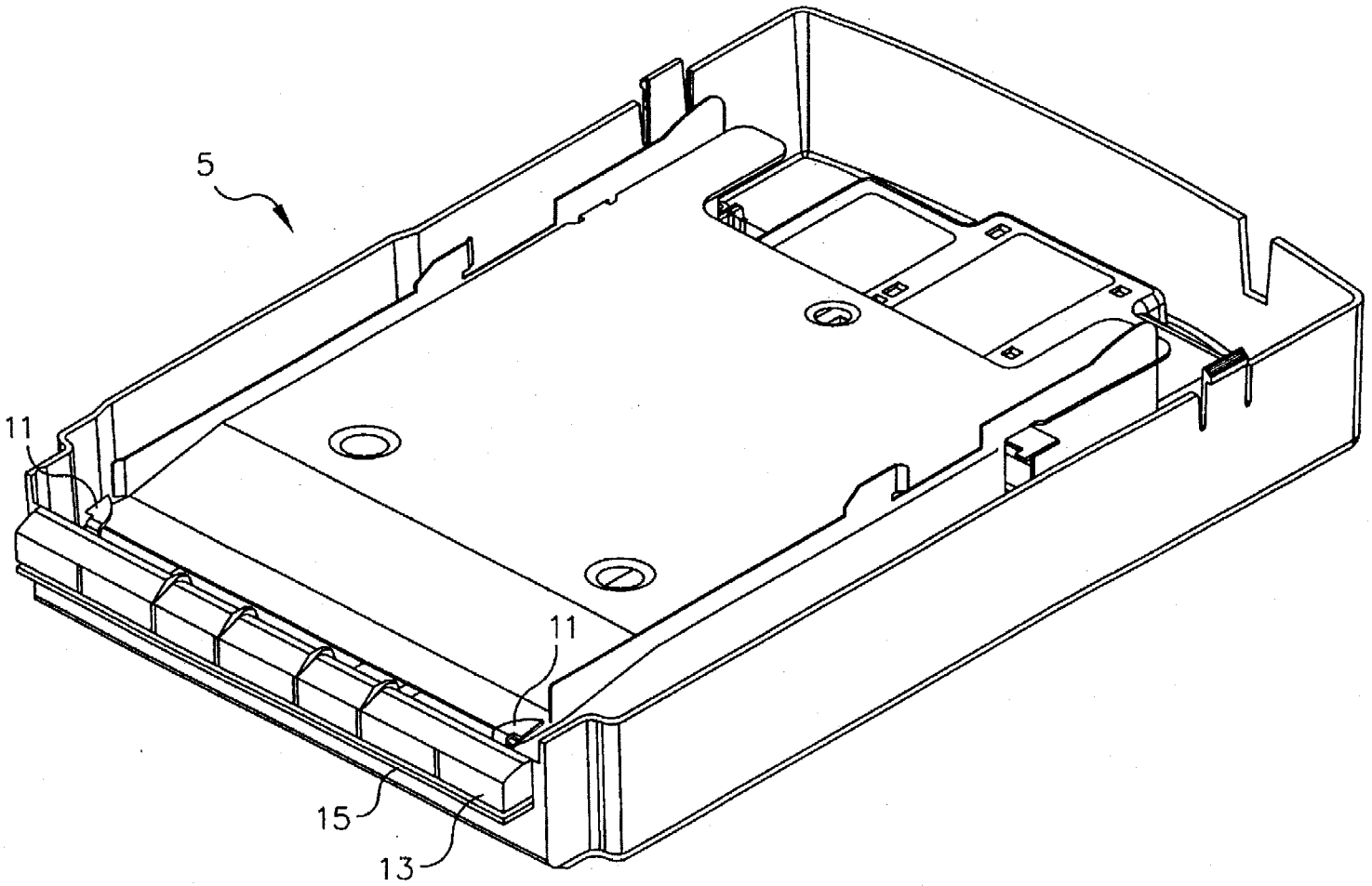
FIGS. 3 and 4 are perspectives of a sheet supply tray.
Figure 4:
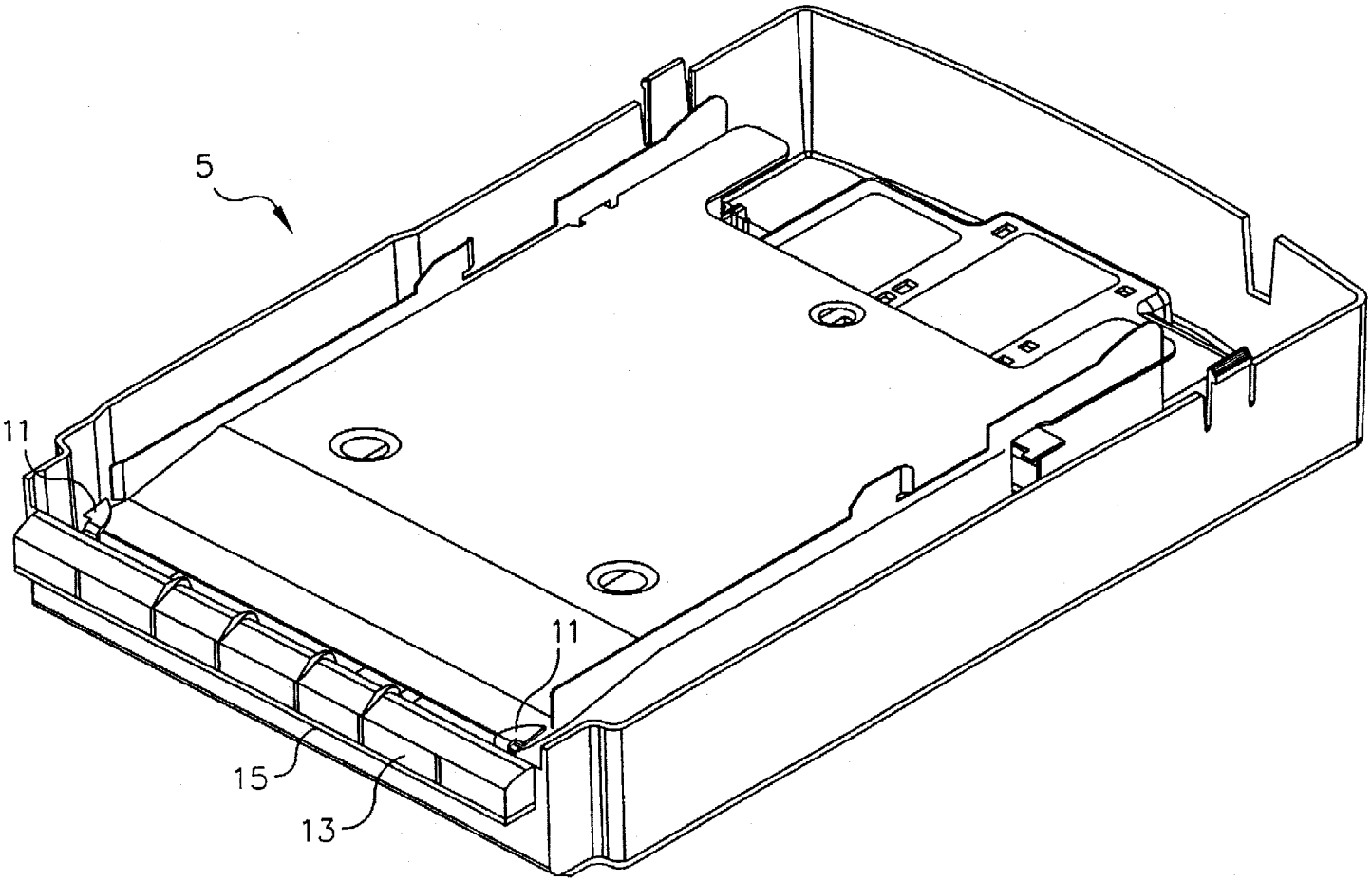

Referring to FIGS. 1 and 2, the invention will be described with respect to its use in a thermal printer 1. Thermal printer 1 includes a sheet supply 3 and a printing station 2. The printing station 2 includes a thermal head 4 which imagewise heats a donor 6 to transfer dye from the donor 6 to a receiving sheet 8 (sometimes called a "receiver"). The donor 6 has more than one area of different colored dye from which different colored images can be transferred in registration to the receiver to form a high quality multicolor image. The receiving sheet 8 is reciprocated through the printing station two or more times to receive the different color images, as will be described below.

The receiving sheet 8 is one of a stack of receiving sheets in a receiving sheet storage tray 5 in sheet supply 3. The stack of sheets has been positioned on a sheet supply platen 7 which is held in an operative position by a set of platen springs 9. A pair of corner devices 11 (sometimes called "nails") are positioned over the corners of the leading edge of the stack.

A scuff roller or other suitable picking device 10 engages the top of the stack and rotates in a clockwise direction to frictionally drive the top sheet 8 to the left, as seen in FIG. 1. The corner devices 11 force a loop or bow in the top sheet which effectively separates it from the stack without double feeds. This type of separation is well known.

The receiving sheet 8 is driven by scuff roller 10 as controlled by a receiving sheet guide 12 to the printing station 2 where it receives the first image from donor 6 while being driven by a platen roller 14 or pinch rollers (not shown). After the first image is completely transferred, the donor is separated from the receiving sheet 8 and the platen roller (or other drive means) is reversed to drive what originally was the trailing portion of the receiving sheet back through the receiving sheet guide 12 into the sheet supply area again. As shown in FIG. 2, to make room for the trailing portion of the sheet 8 as it moves back into the sheet supply area, scuff roller 10 is raised out of engagement with the stack. Without roller 10 in engagement with the stack, platen springs 9 push the platen 7 and the stack upwardly. A guide means, for example, a guide wall 13, is positioned to force the trailing portion of the sheet above the now raised stack. Without guide means 13 the trailing edge of the sheet would abut the stack and cause a jam.

Figure 7:
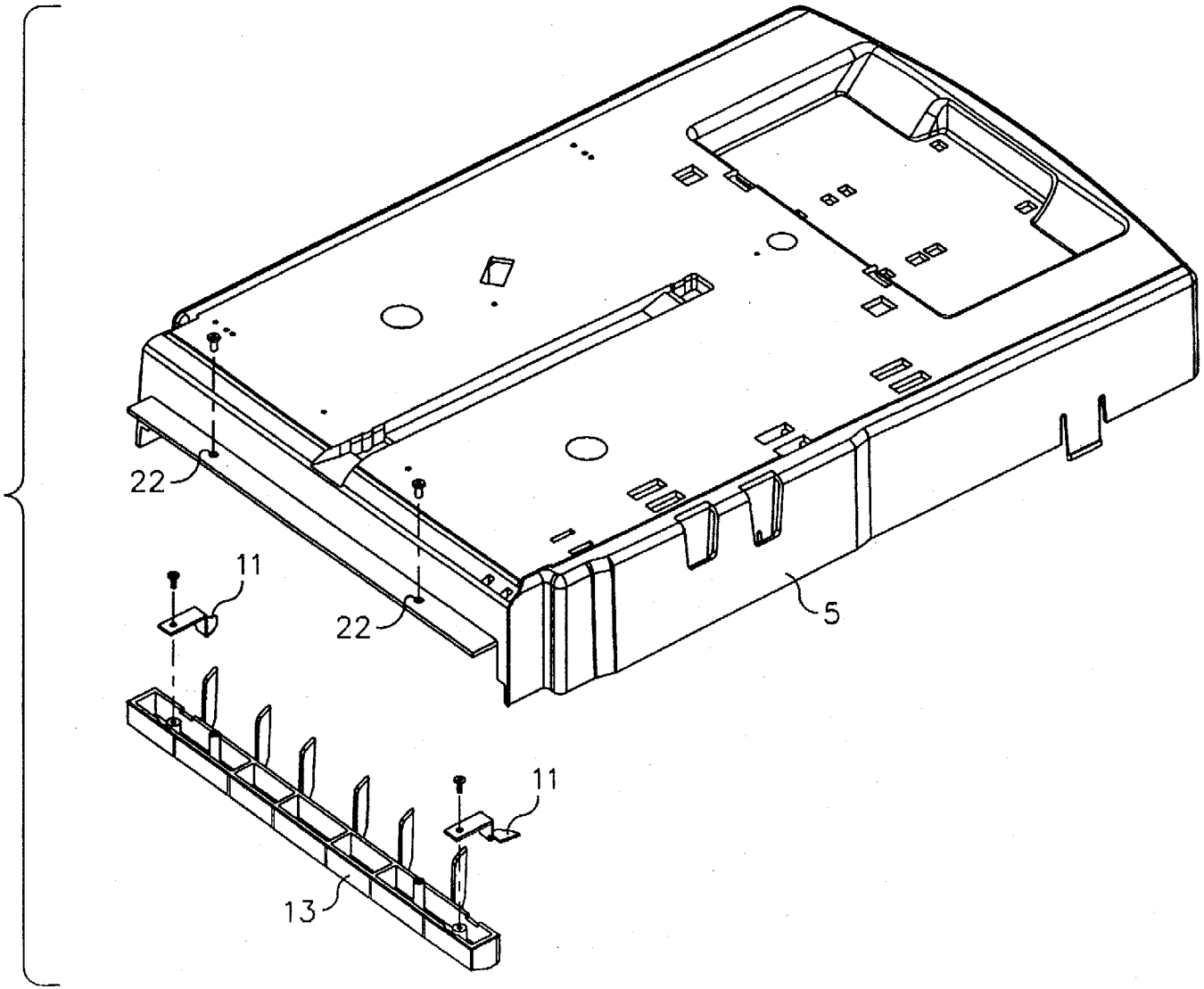
FIG. 7 is a perspective of the bottom of a sheet supply tray with portions exploded.

In the prior devices of this type both the nails 11 and the guide means 13 were fixed to the tray, and the stack was thereby kept by the nails 11 below the top of the guide means. However, the action of the corner devices 11 was not as effective in conditions of changing humidity. Dry and moist conditions caused different direction curl in the receiving sheets, either of which could have a tendency to cause the corner devices 11 to lose contact with the top sheet. It is known in other printers (without the return sheet problem) to use floating corner devices which better maintain contact with the top sheet in the stack. However, floating corner devices in this application allow the stack to sink below the guide 13, causing jams. To solve this problem, applicant has designed guide means 13 to float with corner devices 11. As shown in the drawings, the corner devices 11 are preferably attached to guide means 13 (see especially, FIGS. 5, 6 and 7) as an integral unit. Guide means 13 includes a pair of guide pins 17 which fit in guide pin holes 22 in a guide wall support 15, forming a stationary part of tray 5. Stops 19 for guide pins 17 limit movement in an upward direction of guide means 13 and corner devices 11.

As shown in FIG. 1, while scuff roller 10 is engaged with the stack and pushes the stack down from its weight, the integral unit, made up of guide means 13 and corner devices 11, assumes a lower position by gravity but with corner devices 11 securely in engagement with the top of the stack and guide 13 positioned not to restrict the movement of top sheet 8 to the left.

As shown in FIG. 2, with the scuff roller 10 out of engagement with the stack, the springs 9 push the stack upward and with it the corner devices push up the integral unit where the guide means 13 can direct the returning trailing edge of the receiving sheet to a position above the stack.

Thus, guide means 13 is controlled by the position of corner devices 11 which, in turn, are controlled by the position of the top of the stack and essentially float with the top of the stack. The guide means could be spring urged in a downward direction; however, for this application, gravity has proven to be adequate.

After the sheet 8 has been reversed to the point at which its leading edge is just in the printing station, the platen roller 14, or pinch rollers, is, again, reversed to drive the receiving sheet 8 and the donor 6 again past thermal head 4 to receive another image in registration with the first image. In a three color device, this is repeated another time to form a three color image with the trailing portion of the receiving sheet, again, returned to the sheet supply area in between images.

The invention has been described in detail with particular reference to a preferred embodiment thereof, but it will be understood that variations and modifications can be effected within the spirit and scope of the invention as described hereinabove and as defined in the appended claims.

I claim:

1. A sheet feeding device comprising:

means for supporting a stack of sheets having a top sheet to be fed in a first direction, the top sheet having a leading edge and a trailing portion when fed in the first direction and corners associated with the leading edge, means for engaging the top sheet and pushing the top sheet in the first direction, corner means positioned to engage the corners associated with the leading edge as the sheet is pushed in the first direction to inhibit double feeds, said corner means being vertically movable with the top of the stack, guide means attached to the corner means and mounted for vertical movement in response to the position of the corner means as determined by the top of the stack, said guide means being positioned to engage the trailing portion of a sheet being returned in a second direction opposite the first direction to deflect the trailing portion above the stack.

2. A sheet feeding device according to claim 1 including resilient means urging the stack in an upward direction, wherein the means for engaging and pushing is movable to an out of engagement position with respect to the top of the stack when the trailing portion of a sheet is being returned, which position permits return of the trailing portion and a movement upward of the stack, which upward movement of the stack is followed by the guide means.

3. A sheet feeding device comprising:

means for receiving a stack of sheets having a top sheet, corner means for engaging two corners of a top sheet in a received stack, guide means positioned adjacent a received stack with the corner means between the stack and the guide means, and means for supporting the corner means and guide means for unitary movement between positions determined by the top of the stack.

4. A sheet feeding device comprising:

means for supporting a stack of sheets having an outside sheet to be fed in a first direction, which outside sheet has a leading edge with respect to the first direction and corners associated with the leading edge, means for pushing the outside sheet in the first direction, corner restriction means positioned to engage the corners associated with the leading edge to retard movement of the corners, to inhibit double feeds as the sheet is pushed in the first direction, means for supporting the corner means permitting movement of the corner means with the stack, and guide means positioned downstream in the first direction from the corner means, and means mounting the guide means for movement with the stack.

5. A printer of the type in which a receiving sheet is fed, leading edge first, from a receiving sheet supply to a printing station for printing of a first image and then at least partially returned, trailing edge first, toward the receiving sheet supply from where it is returned to the printing station to receive a second image, wherein the receiving sheet supply includes a sheet feeding device comprising:

means for supporting a stack of receiving sheets having a top sheet to be fed in a first direction, which top sheet has leading and trailing edges with respect to the first direction and corners associated with the leading edge, means for engaging and pushing the top sheet in the first direction, corner means positioned to engage the corners associated with the leading edge to retard movement of said corners as the top sheet is pushed to inhibit double feeds, guide means positioned downstream in the first direction from the corner means and positioned to deflect upward the trailing edge of a receiving sheet as the receiving sheet returns to the receiving sheet supply area, and means for mounting both the guide means and the corner means for unitary vertical movement as controlled by engagement between the corner means and the corners associated with the leading edge of the top sheet.

6. A printer according to claim 5 wherein the means for supporting the sheets is a platen which is spring urged in an upward direction against the force of the pushing means and the pushing means is movable out of engagement with the top sheet when a receiving sheet is being returned toward the receiving sheet supply.

7. For use in a printer as defined in claim 5, a single unitary component including both the guide means and the corner means.

* * * * *